US007731528B2

(12) United States Patent
Feldman et al.

(10) Patent No.: US 7,731,528 B2
(45) Date of Patent: Jun. 8, 2010

(54) ELECTRICAL TERMINATION DEVICE

(75) Inventors: Steven Feldman, Cedar Park, TX (US); Alexander R. Mathews, Austin, TX (US); James G. Vana, Jr., Cedar Park, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/830,703

(22) Filed: Jul. 30, 2007

(65) Prior Publication Data

US 2008/0020615 A1 Jan. 24, 2008

Related U.S. Application Data

(63) Continuation-in-part of application No. 11/627,258, filed on Jan. 25, 2007, now Pat. No. 7,553,187.

(60) Provisional application No. 60/763,733, filed on Jan. 31, 2006, provisional application No. 60/824,332, filed on Sep. 1, 2006.

(51) Int. Cl.
*H01R 9/05* (2006.01)

(52) U.S. Cl. ..... 439/578

(58) Field of Classification Search ..... 439/162, 439/610, 608, 607, 578, 579, 98, 101, 581, 439/585, 580, 108
See application file for complete search history.

(56) References Cited

U.S. PATENT DOCUMENTS

| | | | | |
|---|---|---|---|---|
| 5,046,960 | A | 9/1991 | Fedder | |
| 5,063,659 | A | 11/1991 | Wright | |
| 5,116,230 | A | 5/1992 | Dechelette et al. | |
| 5,184,965 | A | 2/1993 | Myschik et al. | |
| 5,194,020 | A | 3/1993 | Voltz | |
| 5,222,898 | A | 6/1993 | Fedder et al. | |
| 5,431,578 | A | 7/1995 | Wayne | |
| 5,554,050 | A | 9/1996 | Marpoe, Jr. | |
| 5,647,766 | A | 7/1997 | Nguyen | |
| 5,766,036 | A | 6/1998 | Ahmad et al. | |
| 5,938,476 | A * | 8/1999 | Wu et al. | 439/610 |
| 5,964,621 | A | 10/1999 | Wolla et al. | |
| 5,975,950 | A | 11/1999 | Yamaguchi | |
| 6,146,202 | A | 11/2000 | Ramey et al. | |
| 6,203,369 | B1 * | 3/2001 | Feldman | 439/579 |
| 6,231,391 | B1 | 5/2001 | Ramey et al. | |

(Continued)

FOREIGN PATENT DOCUMENTS

| | | |
|---|---|---|
| DE | 41 16 166 | 5/1991 |

(Continued)

*Primary Examiner*—Alexander Gilman
(74) *Attorney, Agent, or Firm*—Johannes P. M. Kusters

(57) ABSTRACT

An electrical termination device includes an electrically conductive shield element, an insulator disposed within the shield element, and one or more electrical contacts supported within and electrically isolated from the shield element by the insulator. The insulator includes one or more insulative spacer bars configured to guide the one or more electrical contacts during their insertion into the insulator. The one or more spacer bars may be configured to enable straight pull injection molding of the insulator. The insulator may be positioned away from the one or more electrical contacts along at least a major portion of the length of the one or more electrical contacts in an impedance controlling relationship. The electrical termination device can be included in an electrical connector.

21 Claims, 6 Drawing Sheets

U.S. PATENT DOCUMENTS

| | | | | |
|---|---|---|---|---|
| 6,257,931 | B1 | 7/2001 | Sakurai et al. | |
| 6,368,120 | B1 | 4/2002 | Scherer et al. | |
| 6,371,813 | B2 | 4/2002 | Ramey et al. | |
| 6,498,506 | B1 | 12/2002 | Beckous | |
| 6,524,135 | B1 * | 2/2003 | Feldman et al. | 439/610 |
| 6,533,609 | B2 * | 3/2003 | Koide | 439/578 |
| 6,540,565 | B2 | 4/2003 | Babel et al. | |
| 6,688,920 | B2 | 2/2004 | Lehner et al. | |
| 6,743,050 | B1 | 6/2004 | Wu | |
| 6,764,350 | B2 | 7/2004 | Kosmala | |
| 6,780,068 | B2 | 8/2004 | Bartholoma et al. | |
| 6,780,069 | B2 | 8/2004 | Scherer et al. | |
| 6,824,427 | B1 | 11/2004 | Feldman et al. | |
| 6,830,480 | B2 | 12/2004 | Yoshioka | |
| 6,849,799 | B2 | 2/2005 | Springer et al. | |
| 6,929,507 | B2 | 8/2005 | Lin | |
| 6,971,916 | B2 | 12/2005 | Tokunaga | |
| 7,021,963 | B2 | 4/2006 | Feldman | |
| 7,044,789 | B2 | 5/2006 | Yohn et al. | |
| 7,044,793 | B2 | 5/2006 | Takemasa | |
| 7,134,911 | B2 | 11/2006 | Bernhart et al. | |
| 7,331,821 | B2 | 2/2008 | Feldman | |
| 7,553,187 | B2 | 6/2009 | Feldman et al. | |
| 2005/0054237 | A1 | 3/2005 | Gladd et al. | |
| 2008/0020615 | A1 | 1/2008 | Feldman et al. | |

FOREIGN PATENT DOCUMENTS

| | | | |
|---|---|---|---|
| EP | 0 570 181 | A2 | 11/1993 |
| JP | 8096864 | A | 4/1996 |
| JP | 10335008 | | 12/1998 |
| JP | 11074037 | A | 3/1999 |
| JP | 2000040563 | | 2/2000 |
| JP | 2000-067980 | | 3/2000 |
| JP | 2002319458 | A | 10/2002 |
| JP | 2002334764 | | 11/2002 |
| WO | WO 2006/120373 | A2 | 11/2006 |

* cited by examiner

ELECTRICAL TERMINATION DEVICE

CROSS REFERENCE TO RELATED APPLICATIONS

This application is a continuation-in-part of U.S. patent application Ser. No. 11/627,258, filed Jan. 25, 2007, now U.S. Pat. No. 7,553,187, which claims priority to U.S. Provisional Patent Application No. 60/763,733, filed Jan. 31, 2006 and U.S. Provisional Patent Application No. 60/824,332, filed Sep. 1, 2006. The disclosures of each of the aforementioned Applications are incorporated by reference herein in their entirety.

TECHNICAL FIELD

The present invention relates to high speed electrical connectors. In particular, the present invention relates to electrical termination devices that can be used in these high speed electrical connectors to facilitate high signal line density and shielded controlled impedance (SCI) for the signal lines.

BACKGROUND

Interconnection of integrated circuits to other circuit boards, cables or electronic devices is known in the art. Such interconnections typically have not been difficult to form, especially when the signal line densities have been relatively low, and when the circuit switching speeds (also referred to as edge rates or signal rise times) have been slow when compared to the length of time required for a signal to propagate through a conductor in the interconnect or in the printed circuit board. As user requirements grow more demanding with respect to both interconnect sizes and circuit switching speeds, the design and manufacture of interconnects that can perform satisfactorily in terms of both physical size and electrical performance has grown more difficult.

Connectors have been developed to provide the necessary impedance control for high speed circuits, i.e., circuits with a transmission frequency of at least 5 GHz. Although many of these connectors are useful, there is still a need in the art for connector designs having increased signal line densities with closely controlled electrical characteristics to achieve satisfactory control of the signal integrity.

SUMMARY

In one aspect, the present invention provides an electrical termination device including an electrically conductive shield element, an insulator disposed within the shield element, and one or more electrical contacts. The one or more electrical contacts are supported within and electrically isolated from the shield element by the insulator, and are configured for making electrical connections through a front end and back end of the shield element. The insulator includes one or more insulative spacer bars configured to guide the one or more electrical contacts during their insertion into the insulator. The insulator may be positioned away from the one or more electrical contacts along at least a major portion of the length of the one or more electrical contacts in an impedance controlling relationship.

In another aspect, the present invention provides an electrical connector including an electrical cable, one or more electrical contacts, an insulator disposed around the one or more electrical contacts, and an electrically conductive shield element. The electrical cable includes one or more conductors and a ground shield surrounding the one or more conductors. The one or more electrical contacts are connected to the one or more conductors. The electrically conductive shield element is disposed around the insulator and connected to the ground shield. The insulator includes one or more insulative spacer bars configured to guide the one or more electrical contacts during their insertion into the insulator.

In another aspect, the present invention provides an insulator having one or more insulative spacer bars configured to guide one or more electrical contacts during their insertion into the insulator. The one or more spacer bars may be configured to enable straight pull injection molding of the insulator. The insulator may be positioned away from the one or more electrical contacts along at least a major portion of the length of the one or more electrical contacts configured to enable an impedance controlling relationship when the insulator and the one or more electrical contacts are in an assembled configuration.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Figure 1:
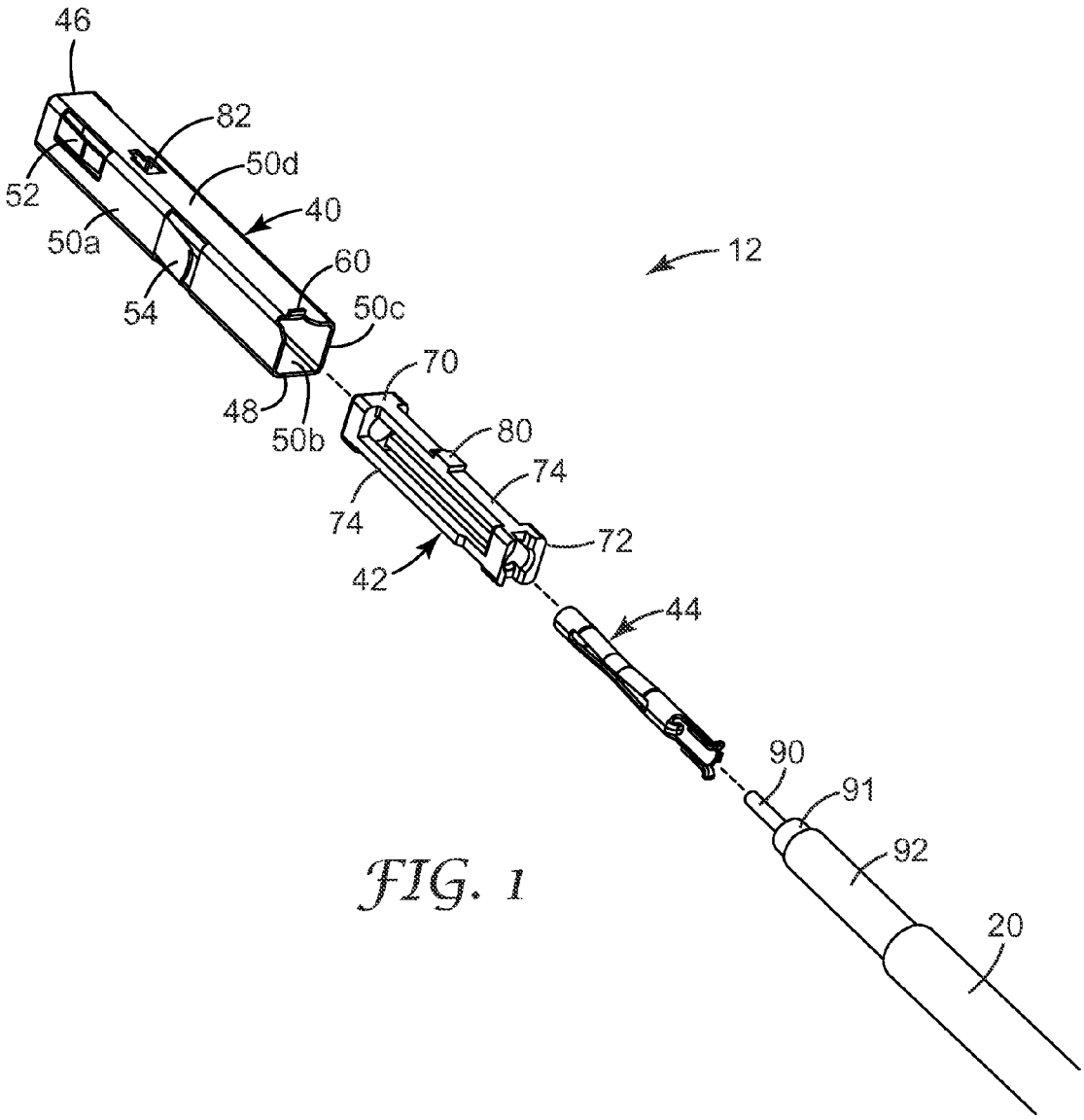
FIG. 1 is an exploded perspective view of an exemplary embodiment of an electrical termination device according to an aspect of the present invention.
Figures 2A, 2B, 2C, 2D:
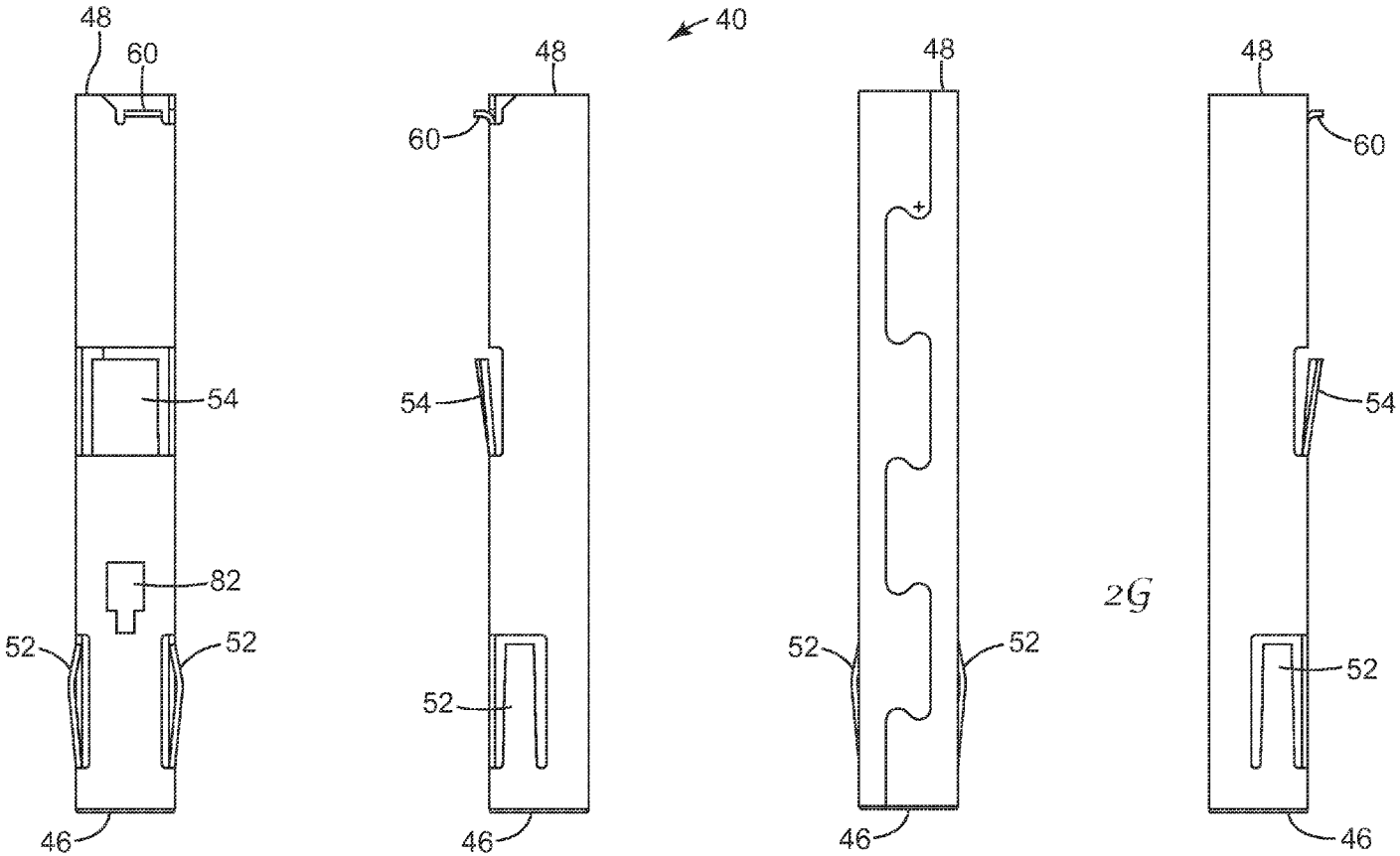
FIGS. 2A-2D are plan views of a shield element of an electrical termination device according to an aspect of the present invention.
Figures 3A, 3B, 3C, 3D:
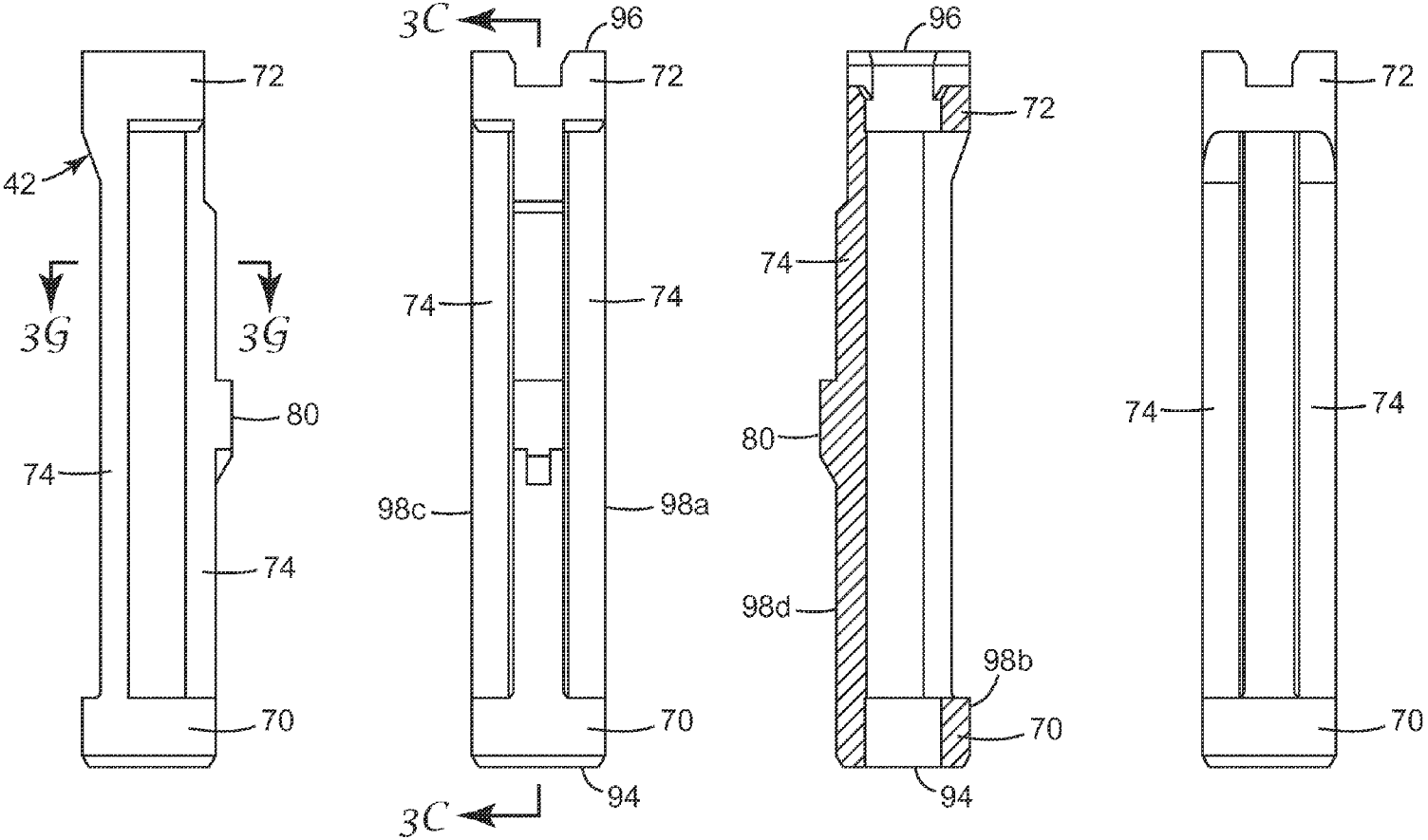
FIGS. 3A-3I are plan and cross-sectional views of the insulator of the electrical termination device of FIG. 1.
Figure 3F:
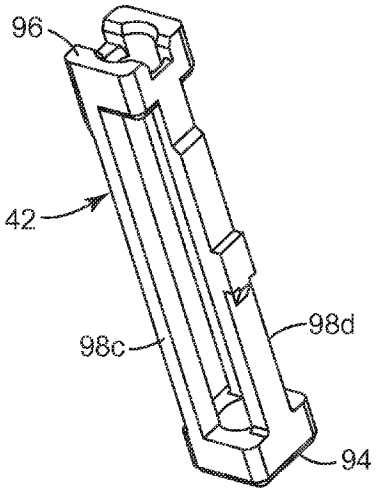
Figure 3E:
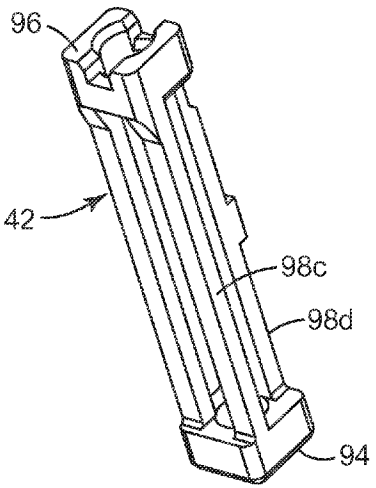
Figure 3I:
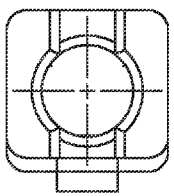
Figure 3H:
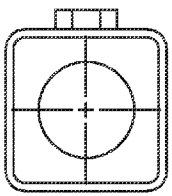
Figure 3G:
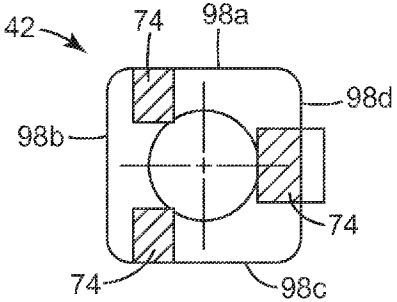
Figure 5A:
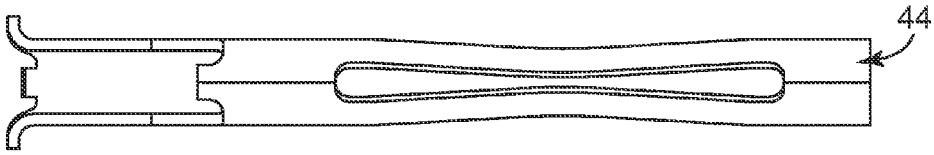
FIGS. 5A-5C are plan and cross-sectional views of the electrical contact of the electrical termination device of FIG. 1.
Figure 5B:
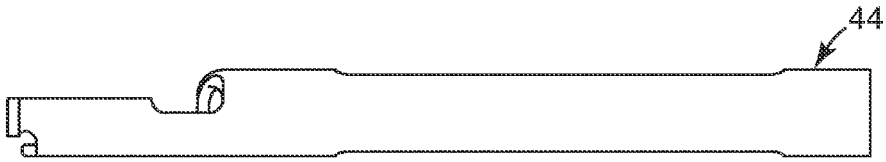
Figure 5C:
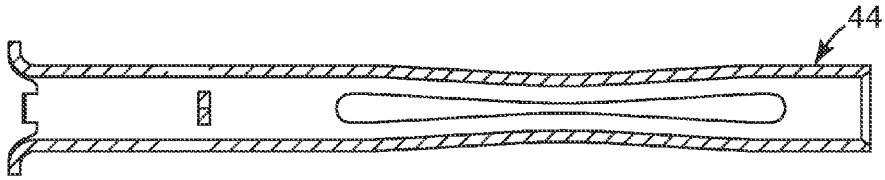

FIGS. 1-3 and 5 illustrate exemplary embodiments of an electrical termination device 12 according to an aspect of the present invention. FIG. 1 shows an exploded view of the exemplary electrical termination device 12 used with an electrical cable 20, while FIGS. 2, 3, and 5 provide detailed views of the individual components of an electrical termination device according to an aspect of the present invention. Electrical termination device 12 includes a longitudinal electrically conductive shield element 40, an insulator 42, and a single electrical contact 44.

Referring to FIGS. 1 and 2A-2D, the electrically conductive shield element 40 has a front end 46, a back end 48, and side surfaces 50*a*-50*d* (collectively referred to herein as "sides 50") defining a non-circular transverse cross-section. Although the illustrated embodiment includes four sides 50 defining a substantially square transverse cross-section, shield element 40 may have other numbers of sides defining other generally rectangular or non-circular transverse cross-sections. In other embodiments, shield element 40 may have a generally curvilinear (such as, e.g., a circular) transverse cross-section. As illustrated, shield element 40 includes laterally protruding resilient ground contact beams 52 disposed on opposed side surfaces 50*a* and 50*c*. In other embodiments, shield element 40 includes only a single ground contact beam 52. A latch member 54 extends from at least one of sides 50. Latch member 54 is configured to retain termination device 12 in a retainer or organizer plate (not shown) configured to receive, secure, and manage a plurality of electrical termination devices. In one embodiment, latch member 54 is designed to yield (i.e., deform) at a lower force than required to break the attached electrical cable 20, so that an electrical termination device 12 can be pulled out of the retainer or organizer plate for the purpose of replacing or repairing an individual electrical termination device and cable assembly. In the illustrated embodiment of FIG. 1, the latch member 54 is shown on a same side 50*a* as one of the ground contact beams 52. However, in other embodiments, the latch member 54 may additionally, or alternatively, be positioned on a side 50 of the shield element 40 that does not include a ground contact beam 52 (FIGS. 2A-2D). Shield element 40 may further include a keying member, in the form of tab 60, laterally extending from back end 48 of shield element 40. Tabs 60 are configured to ensure that electrical termination device 12 is inserted into the retainer or organizer plate in the correct predetermined orientation. If electrical termination device 12 is not properly oriented within the retainer or organizer plate, electrical termination device 12 cannot be fully inserted. In one embodiment, tab 60 is deformable (such as by the use of a tool or the application of excess force in the insertion direction) and may be straightened to allow a damaged or defective electrical termination device 12 to be pushed completely through the retainer or organizer plate, such that the damaged or defective components can be replaced or repaired. Although the figures show that shield element 40 includes ground contact beams 52, it is within the scope of the present invention to use other contact element configurations, such as Hertzian bumps, in place of the contact beams 52.

Referring now to FIGS. 1 and 3A-3I, insulator 42 according to an aspect of the present invention includes one or more insulative spacer bars 74. One or more spacer bars 74 are shaped to receive one or more electrical contacts 44 (FIGS. 5A-5C) and are configured for slidable insertion into shield element 40, such that the one or more electrical contacts 44 lie substantially parallel to a longitudinal axis of shield element 40. One or more spacer bars 74 are configured to guide and optionally support one or more electrical contacts 44 during their insertion into insulator 42. In a preferred embodiment, one or more spacer bars 74 are shaped and positioned relative to one or more electrical contacts 44 and shield element 40 such that air is the dominant dielectric material surrounding one or more electrical contacts 44, so as to lower the effective dielectric constant of electrical termination device 12 and thereby lower the characteristic impedance of the electrical termination device and cable assembly closer to the desired target value, such as, for example, 50 ohms.

A significant advantage of an insulator according to an aspect of the present invention is its skeletonized configuration. A skeletonized configuration, e.g., such as described above, enables the insulator to have an effective dielectric constant of a value close to the dielectric constant of air, which is 1, even though a material with a higher dielectric constant is used to form the insulator. A low effective dielectric constant of insulator 42 allows for more freedom in designing and tolerance in manufacturing electrical contact 44 and shield element 40 of electrical termination device 12 while still meeting a desired target value of the characteristic impedance of the electrical termination device and cable assembly. This can be illustrated using the equation immediately below for calculating the characteristic impedance of a coaxial cable.

$$Z_0=(138/\sqrt{\in})\log(D/d) \qquad \text{Equation 1}$$

where:

$Z_0$ is the characteristic impedance in ohms, $\in$ is the dielectric constant, D is the inner diameter of the cable shield, and d is the diameter of the center conductor.

Although this equation is intended specifically for coaxial cables, it generally shows the relationship between shield element 40 (represented as the inner diameter of the cable shield D), electrical contact 44 (represented as the diameter of the center conductor d), and the effective dielectric constant of insulator 42 (represented as the dielectric constant $\in$). For example, in light of the continuous miniaturization of electrical connectors, a lower effective dielectric constant of insulator 42 allows for a smaller size shield element 40 and thereby a smaller size electrical termination device 12 while still meeting a desired target value of the characteristic impedance of the electrical termination device and cable assembly without the need to reduce the size of electrical contact 44. In addition, a skeletonized configuration, e.g., such as described above, enables at least a substantial portion of the total mass of insulator 42 to be positioned away from one or more electrical contacts 44 (i.e., positioned closer to shield element 40 than to one or more electrical contacts 44) along at least a major portion of the length of one or more electrical contacts 44 in an impedance controlling relationship. An impedance controlling relationship means that one or more electrical contacts 44, insulator 42, and shield element 40 are cooperatively configured to control the characteristic impedance of the electrical termination device and cable assembly. This would bring at least a substantial portion of the total mass of insulator 42 in an area where the electric field strength is lowest, which enables the insulator to have an effective dielectric constant of a value close to the dielectric constant of air, which is 1, even though a material with a higher dielectric constant is used to form the insulator. This can be illustrated using the equation immediately below for calculating the effective dielectric constant in an air gap type coaxial cable (i.e. a coaxial cable having an "air supported dielectric").

$$\varepsilon_r = \frac{\varepsilon_1\varepsilon_2\varepsilon_3\ln(D_3/d)}{\varepsilon_2\varepsilon_3\ln(D_1/d) + \varepsilon_1\varepsilon_3\ln(D_2/D_1) + \varepsilon_1\varepsilon_2\ln(D_3/D_2)} \qquad \text{Equation II}$$

where:

$\in_r$ is the effective dielectric constant, $\in_1$ is the dielectric constant of the space around the center conductor, which is equal to the dielectric constant of air, which is 1, $\in_2$ is the dielectric constant of the cable dielectric, $\in_3$ is the dielectric constant of the space around the cable dielectric, which is equal to the dielectric constant of air, which is 1, $D_1$ is the outer diameter of the space around the center conductor, $D_2$ is the outer diameter of the cable dielectric, $D_3$ is the inner diameter of the cable shield, and d is the diameter of the center conductor.

Although this equation is intended specifically for air gap type coaxial cables, it generally shows the relationship between shield element 40 (represented as the inner diameter of the cable shield $D_3$), electrical contact 44 (represented as the diameter of the center conductor d), and the effective dielectric constant of insulator 42 (represented as the effective dielectric constant $\in_r$). Positioning at least a substantial portion of the total mass of insulator 42 away from electrical contact 44 (i.e., closer to shield element 40 than to electrical contact 44) reduces the effective dielectric constant of insulator 42, allowing for more freedom in designing and tolerance in manufacturing electrical contact 44 and shield element 40 of electrical termination device 12 while still meeting a desired target value of the characteristic impedance of the electrical termination device and cable assembly.

Referring to FIGS. 1 and 3A-3I, insulator 42 has a front end 94, a back end 96, and outer surfaces 98*a*-98*d* (collectively referred to herein as "outer surface 98") defining a non-circular shape. Although the illustrated embodiment includes an outer surface 98 defining a substantially square shape, insulator 42 may have an outer surface 98 defining other suitable shapes, including generally rectangular, non-circular, or curvilinear (such as, e.g., circular) shapes.

Figure 4:
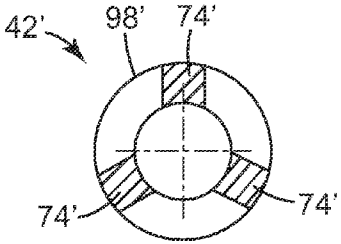
FIG. 4 is a cross-sectional view of another exemplary embodiment of an insulator according to an aspect of the present invention.

FIG. 4 shows a cross-sectional view of an exemplary embodiment of an insulator 42' having an outer surface 98' defining a generally circular shape. This exemplary embodiment includes three spacer bars 74' that are shaped to receive electrical contact 44 (not shown) and are configured for slidable insertion into a shield element (not shown), such that electrical contact 44 lies substantially parallel to a longitudinal axis of the shield element. The three spacer bars 74' are concentrically and substantially evenly spaced around electrical contact 44 and are configured to guide electrical contact 44 during its insertion into insulator 42'. In this configuration, electrical termination device 12 can serve as a coaxial electrical termination device, whereby electrical contact 44 can be connected, e.g., to a single coaxial cable. The illustrated embodiment includes three spacer bars 74' that are concentrically and substantially evenly spaced around electrical contact 44, and are configured to receive one electrical contact 44. In other embodiments, insulator 42' may include one or more spacer bars 74', and spacer bars 74' may be evenly or unevenly spaced around one or more electrical contacts 44.

In the exemplary embodiment of FIGS. 1 and 3A-3I, insulator 42 further includes a first insulative member 70 disposed within shield element 40 adjacent front end 46, and a second insulative member 72 disposed within shield element 40 adjacent back end 48. First and second insulative members 70, 72 are configured to provide structural support to insulator 42. In this embodiment, three spacer bars 74 are provided that properly position and space first and second insulative members 70, 72 with respect to each other. The first and second insulative members 70, 72 and three spacer bars 74 are shaped to receive an electrical contact 44 and are configured for slidable insertion into shield element 40, such that electrical contact 44 lies substantially parallel to a longitudinal axis of shield element 40. The first and second insulative members 70, 72 and three spacer bars 74 are configured to guide electrical contact 44 during its insertion into insulator 42. In this configuration, electrical termination device 12 can serve as a coaxial electrical termination device, whereby electrical contact 44 can be connected, e.g., to a single coaxial cable.

In another embodiment, one or more spacer bars 74 are shaped to receive two electrical contacts 44 and are configured for slidable insertion into shield element 40, such that two electrical contacts 44 lie substantially parallel to a longitudinal axis of shield element 40. One or more spacer bars 74 are configured to guide two electrical contacts 44 during their insertion into insulator 42. In this configuration, electrical termination device 12 can serve as a twinaxial electrical termination device, whereby two electrical contacts 44 can be connected, e.g., to a single twinaxial cable.

In other embodiments, insulator 42 may include two or more mating insulator parts (not shown). Each insulator part may be separately formed or may be integrally hinged in a clamshell fashion to facilitate injection molding or machining and to provide an ease of assembly of one or more electrical contacts 44. The two or more mating insulator parts can be assembled using any suitable method/structure, including but not limited to snap fit, friction fit, press fit, mechanical clamping, and adhesive. In one exemplary embodiment, insulator 42 may include two mating insulator parts, each insulator part extending longitudinally along the length of one or more electrical contacts 44. In another exemplary embodiment, insulator 42 may include two mating insulator parts, each insulator part, which may be hermaphroditic, encompassing substantially one-half the length of one or more electrical contacts 44.

Insulator 42 can be formed of any suitable material, such as, e.g., a polymeric material, by any suitable method, such as, e.g., injection molding, machining, or the like. In one embodiment, insulator 42 is formed by straight pull injection molding, whereby the one or more spacer bars 74 of insulator 42 are configured to enable straight pull injection molding of insulator 42. An advantage of straight pull injection molding is that a straight pull injection mold, as opposed to a side core pull injection mold, can be used to form insulator 42. Generally, a straight pull injection mold requires significantly less precision to manufacture, is significantly less expensive to manufacture (about 25-30%), and requires a significantly less expensive injection molding machine to operate than more the more complex side core pull injection molds. Particularly when making an injection mold with multiple cavities, the cams in a side core pull injection mold are difficult to implement between cavities and cause a significant increase in size and weight of the mold. In addition, straight pull injection molds can generally achieve higher production capacities because they can be made smaller than side core pull injection molds, require less maintenance, and are less likely to malfunction.

Figure 6B:
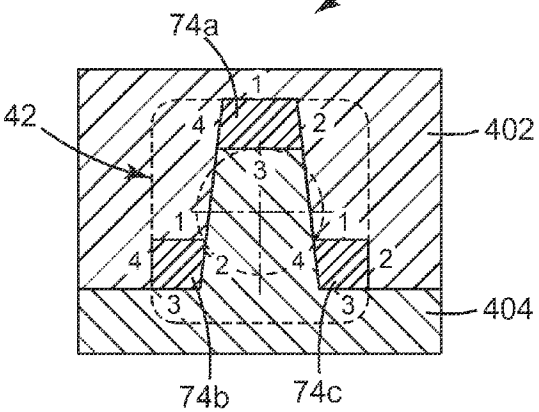
FIGS. 6A-6B are schematic cross-sectional views of a straight pull injection mold that can be used to form the insulator of FIGS. 3A-3I.
Figure 6A:
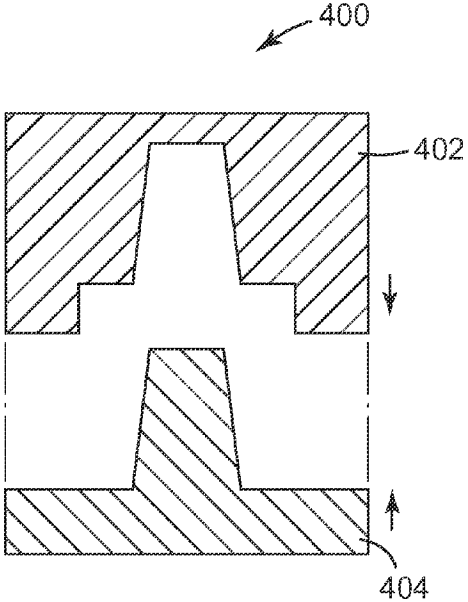

FIGS. 6A-6B show schematic cross-sectional views of an exemplary embodiment of a straight pull injection mold 400 that can be used to form insulator 42. Injection mold 400 includes a first mold half 402 and a second mold half 404 configured to cooperatively form insulator 42 and insulative spacer bars 74*a*-*c* thereof. FIG. 6B shows how insulative spacer bars 74*a*-*c* can be formed by straight pull injection mold 400. First mold half 402 is configured to form sides 1, 2, and 4 of spacer bar 74*a*, sides 1 and 4 of spacer bar 74*b*, and sides 1 and 2 of spacer bar 74*c*. Second mold half 404 is configured to form side 3 of spacer bar 74*a*, sides 2 and 3 of spacer bar 74*b*, and sides 3 and 4 of spacer bar 74*c*.

In the embodiment illustrated in FIG. 1, a spacer bar 74 of insulator 42 includes a laterally protruding positioning and latching element 80 that snaps into a mating opening 82 in shield element 40 to properly position and retain insulator 42 in shield element 40. As insulator 42 (containing one or more electrical contacts 44) is inserted into shield element 40, spacer bar 74 with positioning and latching element 80 deflects inwardly (toward the one or more electrical contacts 44) until engaging with mating opening 82 in shield element 40. Beneficially, if insulator 42 is improperly assembled into shield element 40 (i.e., such that positioning and latching element 80 is not aligned or engaged with opening 82), the presence of positioning and latching element 80 will cause shield element 40 to bulge such that electrical termination device 12 will not fit in the retainer or organizer plate, thereby preventing the installation and use of an improperly assembled electrical termination device 12. In other embodiments, the proper positioning and retaining of insulator 42 may be accomplished by separate elements. For example, insulator 42 may include one or more positioning elements configured to properly position insulator 42 in shield element 40 and/or one or more latching elements configured to properly retain insulator 42 in shield element 40.

In one embodiment, electrical termination device 12 is configured for termination of an electrical cable 20, such that a conductor 90 of electrical cable 20 is attached to electrical contact 44 and ground shield 92 of electrical cable 20 is attached to shield element 40 of electrical termination device 12 using conventional means, such as soldering. The type of electrical cable used in an aspect of the present invention can be a single wire cable (e.g., single coaxial or single twinaxial) or a multiple wire cable (e.g., multiple coaxial, multiple twinaxial, or twisted pair). In one embodiment, prior to attaching one or more electrical contacts 44 to one or more conductors 90 of electrical cable 20, ground shield 92 is stiffened by a solder dip process. After one or more electrical contacts 44 are attached to one or more conductors 90, the one or more electrical contacts 44 are slidably inserted into insulator 42. The prepared end of electrical cable 20 and insulator 42 are configured such that the stiffened ground shield 92 bears against end 72 of insulator 42 prior to one or more electrical contacts 44 being fully seated against end 70 of insulator 42. Thus, when insulator 42 (having one or more electrical contacts 44 therein) is next slidably inserted into shield element 40, the stiffened ground shield 92 acts to push insulator 42 into shield element 40, and one or more electrical contacts 44 are prevented from pushing against insulator 42 in the insertion direction. In this manner, one or more electrical contacts 44 are prevented from being pushed back into electrical cable 20 by reaction to force applied during insertion of insulator 42 into shield element 40, which may prevent proper connection of one or more electrical contacts 44 with a header.

In one embodiment, electrical termination device 12 includes two electrical contacts 44 and is configured for termination of an electrical cable 20 including two conductors 90. Each conductor 90 of electrical cable 20 is connected to an electrical contact 44 of electrical termination device 12, and ground shield 92 of electrical cable 20 is attached to shield element 40 of electrical termination device 12 using conventional means, such as soldering. The type of electrical cable used in this embodiment can be a single twinaxial cable.

In one embodiment, second insulative member 72 of insulator 42, at least a portion of electrical cable 20, and at least a portion of one or more electrical contacts 44 are cooperatively configured in an impedance controlling relationship. For example, referring to the embodiment illustrated in FIG. 1, to facilitate connection of conductor 90 of electrical cable 20 to electrical contact 44 of electrical termination device 12, a portion of dielectric 91 of electrical cable 20 can be removed. Removing a portion of dielectric 91 changes the effective dielectric constant, and thereby the characteristic impedance of the assembly, in this area. The change in effective dielectric constant as a result of the removal of a portion of dielectric 91 of electrical cable 20 can be countered by adjusting the design of second insulative member 72 to bring the characteristic impedance of the electrical termination device and cable assembly closer to the desired target value, such as, for example, 50 ohms.

In one embodiment, first and second insulative members 70, 72 and spacer bars 74 of insulator 42 are configured to provide an open path between the area of shield element 40 to be soldered to ground shield 92 and the area under latch 54 of shield element 40, such that solder flux vapor may be vented during soldering.

In each of the embodiments and implementations described herein, the various components of the electrical termination device and elements thereof are formed of any suitable material. The materials are selected depending upon the intended application and may include both metals and non-metals (e.g., any one or combination of non-conductive materials including but not limited to polymers, glass, and ceramics). In one embodiment, insulator 42 is formed of a polymeric material by methods such as injection molding, extrusion, casting, machining, and the like, while the electrically conductive components are formed of metal by methods such as molding, casting, stamping, machining the like. Material selection will depend upon factors including, but not limited to, chemical exposure conditions, environmental exposure conditions including temperature and humidity conditions, flame-retardancy requirements, material strength, and rigidity, to name a few.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical termination device comprising:

an electrically conductive shield element having a front end and a back end;

an insulator disposed within the shield element and comprising:

a first insulative member disposed at the front end of the shield element and shaped to align the insulator at the front end of the shield element;

a second insulative member having a substantially closed perimeter and being disposed at the back end of the shield element and shaped to align the insulator at the back end of the shield element, the second insulative member spaced apart from the first insulative member by a gap; and one or more insulative spacer bars longitudinally extending between the first and second insulative members across the gap; and one or more electrical contacts supported within and electrically isolated from the shield element by the insulator, the one or more electrical contacts configured for making electrical connections through the front end and back end of the shield element, wherein the one or more insulative spacer bars are configured to guide the one or more electrical contacts during insertion of the one or more electrical contacts into the insulator.

2. The electrical termination device of claim 1, wherein at least a substantial portion of the insulator is positioned closer to the shield element than to the one or more electrical contacts.

3. The electrical termination device of claim 1, wherein the insulator is positioned away from the one or more electrical contacts along at least a major portion of the length of the one or more electrical contacts in an impedance controlling relationship.

4. An electrical connector comprising:

an electrical cable including one or more conductors and a ground shield surrounding the one or more conductors;

one or more electrical contacts connected to the one or more conductors;

an electrically conductive shield element connected to the around shield and having a front end and a back end; and an insulator disposed within the shield element and around the one or more electrical contacts, the insulator comprising:

a first insulative member disposed at the front end of the shield element and shaped to align the insulator at the front end of the shield element;

a second insulative member having a substantially closed perimeter and being disposed at the back end of the shield element and shaped to align the insulator at the back end of the shield element, the second insulative member spaced apart from the first insulative member by a gap; and one or more insulative spacer bars longitudinally extending between the first and second insulative members across the gap and configured to guide the one or more electrical contacts during insertion of the one or more electrical contacts into the insulator.

5. The electrical connector of claim 4, wherein one or both of the first and second insulative members, at least a portion of the electrical cable, and at least a portion of the one or more electrical contacts are cooperatively configured in an impedance controlling relationship.

6. The electrical connector of claim 4, wherein the electrical cable includes two conductors and wherein each conductor is connected to an electrical contact.

7. An insulator comprising:

a first insulative member shaped to align the insulator at a front end of a shield element;

a second insulative member having a substantially closed perimeter and being shaped to align the insulator at a back end of the shield element, the second insulative member spaced apart from the first insulative member by a gap; and one or more insulative spacer bars longitudinally extending between the first and second insulative members across the gap and configured to guide one or more electrical contacts during insertion of the one or more electrical contacts into the insulator.

8. The insulator of claim 7, wherein the insulator is positioned away from the one or more electrical contacts along at least a major portion of the length of the one or more electrical contacts configured to enable an impedance controlling relationship when the insulator and the one or more electrical contacts are in an assembled configuration.

9. The insulator of claim 7, wherein the one or more insulative spacer bars are configured to guide two electrical contacts during insertion of the two electrical contacts into the insulator.

10. The insulator of claim 7, wherein the one or more spacer bars are configured to enable straight pull injection molding of the insulator.

11. The insulator of claim 7, wherein one or both of the first and second insulative members are configured to provide structural support to the insulator.

12. The insulator of claim 7, wherein one or both of the first and second insulative members provide guidance to the one or more electrical contacts during insertion of the one or more electrical contacts into the insulator.

13. The insulator of claim 7 further comprising two or more mating insulator parts.

14. The insulator of claim 7 further comprising a positioning element configured to position the insulator in a shield element.

15. The insulator of claim 7 further comprising a latching element configured to retain the insulator in a shield element.

16. The insulator of claim 7 further comprising a positioning and latching element configured to position and retain the insulator in a shield element.

17. The insulator of claim 7, wherein the insulator includes an outer surface defining a generally rectangular shape.

18. The insulator of claim 7, wherein the insulator includes an outer surface defining a generally curvilinear shape.

19. The insulator of claim 7, wherein the insulator is formed by at least one of injection molding and machining.

20. The insulator of claim 7, wherein the insulator is formed by straight pull injection molding.

21. The insulator of claim 7, wherein the one or more insulative spacer bars are configured to retain the first and second insulative members in a fixed relative position.

* * * * *

UNITED STATES PATENT AND TRADEMARK OFFICE

CERTIFICATE OF CORRECTION

PATENT NO. : 7,731,528 B2
APPLICATION NO. : 11/830703
DATED : June 8, 2010
INVENTOR(S) : Steven Feldman It is certified that error appears in the above-identified patent and that said Letters Patent is hereby corrected as shown below:

Column 9,
Line 22, in claim 4, delete “around” and insert --ground-- therefor.

Signed and Sealed this
Twenty-second Day of February, 2011

David J. Kappos

David J. Kappos
*Director of the United States Patent and Trademark Office*